US007980260B2

(12) United States Patent
Bertsch et al.

(10) Patent No.: US 7,980,260 B2
(45) Date of Patent: Jul. 19, 2011

(54) DISHWASHER WITH DRIVEN ROTATABLE SPRAY ARM

(75) Inventors: Roger James Bertsch, Stevensville, MI (US); Jordan Robert Fountain, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/761,438

(22) Filed: Apr. 16, 2010

(65) Prior Publication Data

US 2010/0192995 A1 Aug. 5, 2010

Related U.S. Application Data

(63) Continuation of application No. 12/336,033, filed on Dec. 16, 2008.

(51) Int. Cl.
*B08B 3/12* (2006.01)
*B08B 6/00* (2006.01)
*B08B 3/00* (2006.01)

(52) U.S. Cl. ..... 134/181; 134/56 D; 134/57 D; 134/58 D; 134/180

(58) Field of Classification Search ..... 134/176, 134/179, 56 D, 57 D, 58 D, 180, 181
See application file for complete search history.

(56) References Cited

U.S. PATENT DOCUMENTS

| | | | | |
|---|---|---|---|---|
| 3,095,885 | A | | 7/1963 | Hertell |
| 4,589,158 | A | * | 5/1986 | Sheldon ..... 15/88.3 |
| 4,884,585 | A | | 12/1989 | Oh |
| 4,993,444 | A | | 2/1991 | Toriyama et al. |
| 5,330,580 | A | | 7/1994 | Whipple, III et al. |
| 5,415,350 | A | * | 5/1995 | Yoon et al. ..... 239/227 |
| 5,464,482 | A | | 11/1995 | Michael et al. |
| 5,494,062 | A | | 2/1996 | Springer |
| 5,579,789 | A | * | 12/1996 | Spiegel ..... 134/104.1 |
| 5,655,556 | A | | 8/1997 | Guerrera et al. |
| 5,673,714 | A | | 10/1997 | Campagnolo et al. |
| 5,849,101 | A | | 12/1998 | Edwards et al. |
| 6,092,540 | A | | 7/2000 | Chiao |
| 6,925,659 | B2 | | 8/2005 | Sato et al. |
| 2005/0011544 | A1 | | 1/2005 | Rosenbauer et al. |
| 2006/0237044 | A1 | | 10/2006 | Ferguson et al. |
| 2006/0260649 | A1 | | 11/2006 | Lee |
| 2006/0278258 | A1 | | 12/2006 | Kara et al. |
| 2007/0068562 | A1 | | 3/2007 | Wetzel et al. |

FOREIGN PATENT DOCUMENTS

| | | | |
|---|---|---|---|
| GB | 550511 | | 1/1943 |
| GB | 2151464 | A * | 7/1985 |
| JP | 04049935 | A * | 2/1992 |
| JP | 09253020 | A * | 9/1997 |
| JP | 10117993 | A | 5/1998 |

OTHER PUBLICATIONS

JP 09-253020 Machine Translation.*

* cited by examiner

*Primary Examiner* — Michael Barr
*Assistant Examiner* — Charles W Kling
(74) *Attorney, Agent, or Firm* — Robert A. Bacon; McGarry Bair PC

(57) ABSTRACT

An automatic dishwasher having a tub defining a wash chamber for receiving utensils to be washed and including a rotatable spray arm located within the wash chamber and a liquid recirculation system for selectively supplying liquid to the rotatable spray arm and where the rotatable spray arm is driven with a power unit.

11 Claims, 7 Drawing Sheets

DISHWASHER WITH DRIVEN ROTATABLE SPRAY ARM

CROSS-REFERENCE TO RELATED APPLICATION

This application is a continuation of U.S. patent application Ser. No. 12/336,033, filed Dec. 16, 2008, which is incorporated herein by reference in its entirety.

BACKGROUND OF THE INVENTION

Contemporary dishwashers include a tub defining a wash chamber within which is provided a rack for holding dishes. Typically, there is an upper and lower rack or basket for supporting soiled utensils within the tub. A pump is provided for re-circulating wash liquid throughout the tub to remove soils from the utensils. Rotating spray arms are typically positioned beneath each rack and are supplied liquid from the pump, which effects the rotation of the arm as it is sprayed onto the rack.

SUMMARY OF THE INVENTION

In one aspect, the invention is directed to an automatic dishwasher having a rotatable spray arm that is driven when a power unit is actuated. The rotatable spray arm may have a drive gear enmeshed with an output gear of a drive shaft extending horizontally in the wash chamber. The power unit may be operably coupled to the drive shaft such that when the power unit provides an operating force to the rotate the drive shaft the spray arm is rotated.

DESCRIPTION OF AN EMBODIMENT OF THE INVENTION

Figure 1:
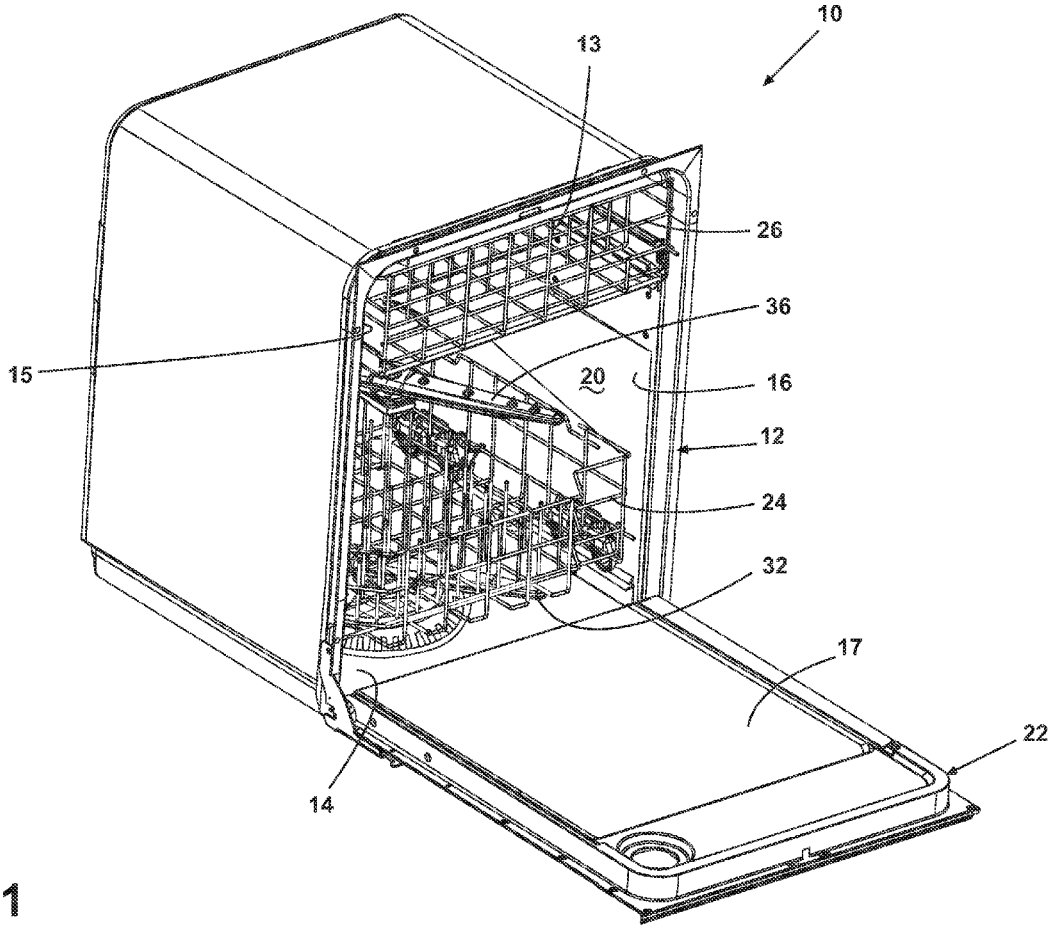
FIG. 1 is a perspective view of a dishwasher according to one embodiment of the invention.

Referring to FIG. 1, a first embodiment of the invention may be illustrated as a cleaning appliance in the environment of a dishwasher 10. Although much of the remainder of this application will focus on the embodiment of a dishwasher 10, the invention may have utility in other environments, including other cleaning appliances, especially in automatic clothes washing machines and dryers. The dishwasher 10 shares many features of a conventional automated dishwasher, which will not be described in detail herein except as necessary for a complete understanding of the invention.

The dishwasher 10 includes a housing 12 having a top wall 13, bottom wall 14, two side walls 15, 16, a front wall 17, and a rear wall 18. The walls 13, 14, 15, and 16 collectively define a treating chamber 20. The front wall 17 may be a door 22 of the dishwasher 10, which is moveable to provide access to and to selectively close the treating chamber 20 for loading and unloading consumer articles such as utensils or other washable items. While the present invention is described in terms of a conventional dishwashing unit, it could also be implemented in other types of dishwashing units, such as in-sink dishwashers or drawer-type dishwashers.

Figure 2:
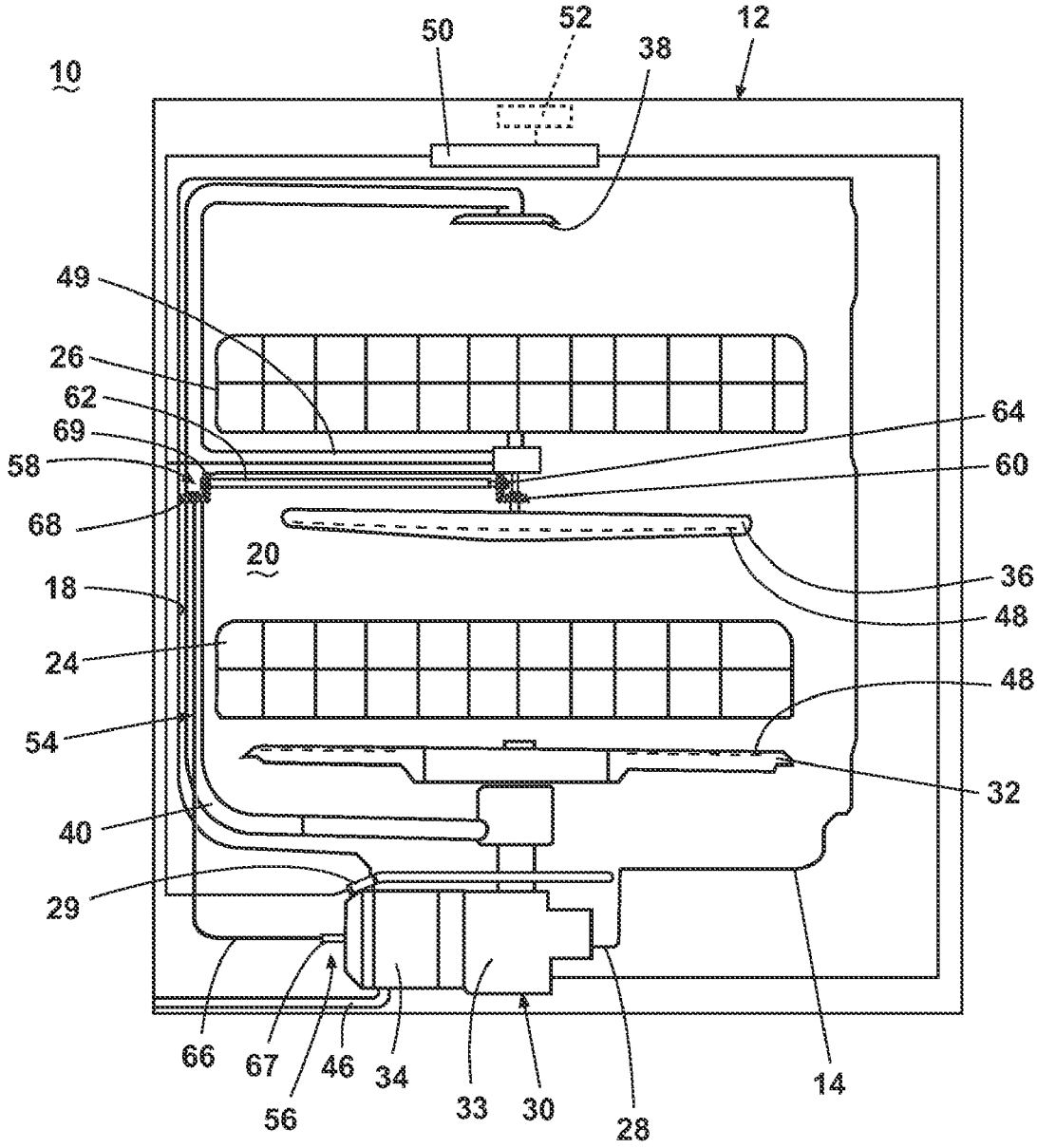
FIG. 2 is a side schematic view of the dishwasher of FIG. 1.

Referring to FIG. 2, utensil holders in the form of a first rack or lower utensil rack 24 and a second or upper utensil rack 26 are located within the wash chamber 20 and receive utensils for washing. The lower and upper utensil racks 24, 26 are typically mounted for slidable movement in and out of the wash chamber 20 for ease of loading and unloading. For example, each of the lower and upper utensil racks 24, 26 is selectively moveable between a loading position where at least a portion of the lower and upper utensil racks 24, 26 extends exteriorly of the wash chamber 20 and a wash position where the lower and upper utensil racks 24, 26 are located entirely within the wash chamber 20. As used in this description, the term utensil is generic to consumer articles such as dishes and the like that are washed in the dishwasher 10 and expressly includes, dishes, plates, bowls, silverware, glassware, stemware, pots, pans, and the like.

The bottom wall 14 of the dishwasher 10 may be sloped to define a lower tub region or sump 28. A heater 29 is located within the sump 28 for heating the liquid contained in the sump 28. A pump assembly 30 may be located in or around a portion of the bottom wall 14 and in fluid communication with the sump 28 to draw wash liquid from the sump 28 and to pump the liquid to at least a lower spray arm assembly 32.

The pump assembly 30 may have both a recirculation pump 33 and a drain pump 34. The pump assembly 30 may have a motor that provides it power (not shown). If the dishwasher 10 has a mid-level spray arm assembly 36 and/or an upper spray arm assembly 38, liquid may be selectively pumped through a supply tube 40 to each of the assemblies 32, 36, 38 for selective wash. In this way, the pump assembly 30 can draw wash liquid collecting in the sump 28 and distribute it through the sprayers 32, 36, 38 into the wash chamber 20, where it naturally flows back to the sump 28 for recirculation or draining as the case may be. The drain pump 34 may be used to drain liquid from the sump 28 out of the dishwasher 10 through a drain conduit 46.

The lower spray arm assembly 32 is positioned beneath the lower utensil rack 24, the mid-level spray arm assembly 36 is positioned between the upper utensil rack 26 and the lower utensil rack 24, and the upper spray arm assembly 38 is positioned above the upper utensil rack 26. The lower spray arm assembly 32 is configured to move within a range of motion. As illustrated, the lower spray arm assembly rotates such that the range of motion is limited to area encompassed within one revolution. As the lower spray arm assembly rotates in the wash chamber 20, it generates a spray a flow of wash liquid from at least one outlet 48, in a generally upward direction, over a portion of the interior of the wash chamber 20. The spray from the lower spray arm assembly 32 is typically directed to treat utensils located in the lower utensil rack 24.

Like the lower spray arm assembly 32, the mid-level spray arm assembly 36 may also be configured to move within a predetermined range of motion and more particularly to rotate in the dishwasher 10 about an axis of rotation and spray a flow of wash liquid from at least one outlet 48, in a generally upward direction, over a portion of the interior of the wash chamber 20. In this case, the spray from the mid-level spray arm assembly 36 is directed to utensils in the upper utensil rack 26. In contrast, the upper spray arm assembly 38 generally directs a spray of wash liquid in a generally downward direction and helps treat utensils on both utensil racks 24, 26. Because the mid-level spray arm assembly 36 is mounted to the upper utensil rack 26, it and its components may be able to move in and out of the wash chamber 20. A flexible manifold tube 49 allows for such movement and is fluidly connected to the supply tube 40 to supply liquid to the mid-level spray arm assembly 36.

The pump assembly 30, spray arm assemblies 32, 36, 38, and supply tube 40 collectively form a liquid recirculation system for spraying liquid within the wash chamber 20. While the spray arm assemblies 32 and 36 are illustrated as rotating spray arms and upper spray arm assembly 38 is illustrated as a fixed spray head, the spray arm assemblies can be of any structure and configuration. The dishwasher 10 may further include other conventional components such as additional spray arms or nozzles, a drain pump, a filter, a heater, etc.; however, these components are not germane the present invention and will not be described further herein.

A controller 50 may be operably coupled to the pump assembly 30, drain pump assembly 34, and various components of the dishwasher 10 to implement a cleaning cycle. The dishwasher 10 may be preprogrammed with a number of different cleaning cycles from which a user may select one cleaning cycle to clean a load of utensils. Examples of cleaning cycles include normal, light/china, heavy/pots and pans, and rinse only. A control panel or user interface 52 provided on the dishwasher 10 and coupled to the controller 50 may be used to select a cleaning cycle. The control panel 52 can be provided on the outer panel of the door 22 and can include operational controls such as dials, lights, switches, and displays enabling a user to input commands to the controller 50 and receive information about the selected cleaning cycle. Alternately, the cleaning cycle may be automatically selected by the controller 50 based on soil levels sensed by the dishwasher 10 to optimize the cleaning performance of the dishwasher 10 for a particular load of utensils.

A drive system 54 is provided for rotating the mid-level spray arm assembly 36. The drive system includes a power unit 56 and a drive unit 58. The power unit 56 supplies the power or driving force to the drive unit 58, which uses the power to drive the rotation of the spray arm assembly 36. It is contemplated, but not necessary, that the power unit 56 is fixed somewhere in the appliance, while the drive unit is carried by the rack, with the movement of the rack into and out of the wash chamber 20 functioning to couple and uncouple the power unit 56 and drive unit 58.

The power unit 56 includes the motor of the pump assembly 30 and a cable 66 operably coupled to a drive shaft 67 of the motor of the pump assembly 30 to rotate the cable 66. The cable 66 is rotated around its longitudinal axis and in this way functions similar to a rigid drive shaft, with one difference being that the cable is flexible, which provides for easier positioning within the appliance. The end of the cable 66 opposite the motor can be thought of as the output end of the cable and the output of the power unit 56. A cable gear 68 is located at the output end of the cable.

The drive unit 58 is carried by the upper utensil rack 26 and is illustrated as including a drive shaft 62 for coupling to the power unit and a mid-level spray arm gear 60 carried by the mid-level spray arm assembly 36. The mid-level spray arm gear 60 is ultimately driven by the drive shaft to rotate the mid-level spray arm assembly 36.

To couple the drive shaft 62 to the mid-level spray arm gear 60, a drive shaft output gear 64, a first gear, is provided on one end of the drive shaft 62 and meshes with the mid-level spray arm gear 60, a second gear. To couple the drive shaft 62 to the power unit 56, a drive shaft input gear 69 is provided on the other end of the drive shaft 62 and meshes with the cable gear 68, when the rack is stored in the treatment chamber.

The paired mid-level spray arm gear 60/drive shaft output gear 64 and cable gear 68/drive shaft input gear 69 have been illustrated as miter gear assemblies. However, the gear pairs may be any suitable mechanism for transferring the respective rotational motion. Alternative mechanisms may include bevel gears, crossed helical gears or a worm gear assembly where the gear may actually be formed in the drive shaft. In the case of the cable gear 68/drive shaft input gear 69 another alternative may include the cable 66 directly connected to the drive shaft 62. Furthermore, a motor separate from the pump assembly 30 may be used to provide the rotational movement to the cable 66.

The drive shaft 62 may selectively couple the cable 66 in response to the sliding in and out of the rack 26. The output of the cable 66 may be aligned with the drive unit 58 such that they may be coupled when the upper utensil rack 26 is in the wash position. The cable 66 may be supported at its output to accomplish the alignment. Alternatively, the cable 66 may be flexible enough to allow movement of the mid-level spray arm assembly 36 and the drive unit 58 to both the wash position and the loading position. Thus, when the drive unit 58 and mid-level spray arm assembly 36 are in the wash position it is coupled to the power unit 56 and the power unit 56 may provide an operating force to the drive unit 58 to effect the rotation of the mid-level spray arm assembly 36.

During operation of the dishwasher 10, the controller 50 may be employed to control the operation of the pump assembly 30 and its drive shaft 67. The operation of the pump assembly 30 draws liquid from the sump 28 and delivers it to one or more of the spray arm assemblies 32, 36, 38 where the liquid is sprayed back into the wash chamber 20 and drains back to the sump 28 where the process is repeated. As the recirculating pump assembly 30 is operated, the drive shaft 67 rotates and drives the cable 66. In turn, the cable 66 rotates the cable gear 68, the drive shaft input gear 69, the drive shaft 62, and the drive shaft output gear 64 located on the output of the drive shaft. The drive shaft output gear 64 interconnects with the mid-level spray arm gear 60 that in turn drives rotation of the mid-level spray arm assembly 36.

With this configuration, the operation of the pump may be used to control the rotation of the mid-level spray arm 36. The pump may be driven by a variable speed motor to further control the speed of rotation of the mid-level spray arm 36. The rotational speed of the arm 36 relative to the rotation speed of the cable may be controlled or set by selecting the relative size of one or more of the gears 60, 64, 68, 69 to define a gear ratio.

Figure 3:
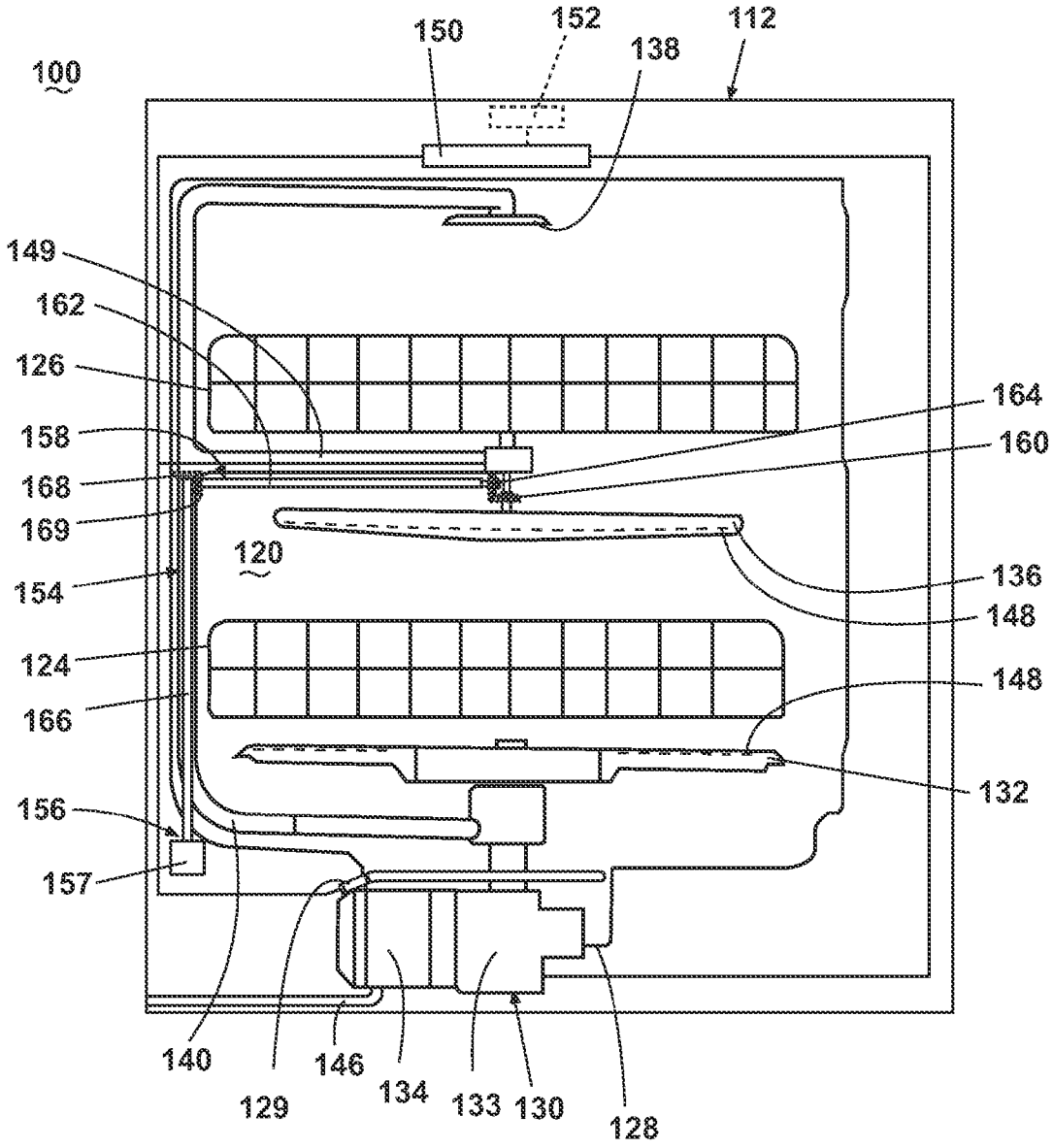
FIG. 3 is a side schematic view of the dishwasher according to another embodiment of the invention.

FIG. 3 is a side schematic view of a dishwasher 100 and drive system 154 according to a second embodiment of the invention. The second embodiment 100 is similar to the first embodiment 10. Therefore, like parts will be identified with like numerals increased by 100, with it being understood that the description of the like parts of the first embodiment applies to the second embodiment, unless otherwise noted.

One difference between the first embodiment 10 and the second embodiment 100 is that the power unit 156 uses a stand alone motor 157, instead of the pump 34, and a drive shaft 166 and an output gear 168 located at the output end of the drive shaft 166, instead of the cable 66 and cable gear 68. This configuration provides for the independent control of the position of the spray arm assembly 136 and the spraying of liquid therefrom. Many useful spray strategies can be adopted when the position of the spray arm is controlled independently of the supply of liquid through the spray arm. For example, the spray arm may be stopped or slowed at locations where a greater spraying is desired, such as when the spray arm is directed to the corners of the rack.

During operation of the dishwasher 100, the controller 150 may be employed to control the operation of the motor 157. The motor 157 may be able to operate in both a forward and reverse direction, if all of the components of the drive system 154 are capable of operating in both directions, then the mid-level spray arm assembly 136 may be driven in both a first rotational direction and in a direction opposite from the first rotational direction. This may help to clean utensils in the upper utensil rack 126. The controller 150 may control the time the motor 157 is operated in each direction. Further, the controller 150 may operate the motor to slow or even stop the mid-level spray arm assembly 136. Slowing or stopping the rotation of the mid-level spray arm assembly may allow for better cleaning in certain areas of the wash chamber 120. During this time, the controller 150 may also operate the pump assembly 130 to deliver liquid to one or more of the spray arm assemblies 132, 136, 138. Thus, a difference between the second embodiment and the first embodiment is that rotation of the mid-level spray arm assembly 136 may be stopped while the pump assembly 130 is delivering liquid to the mid-level spray arm assembly 136.

Figure 4:
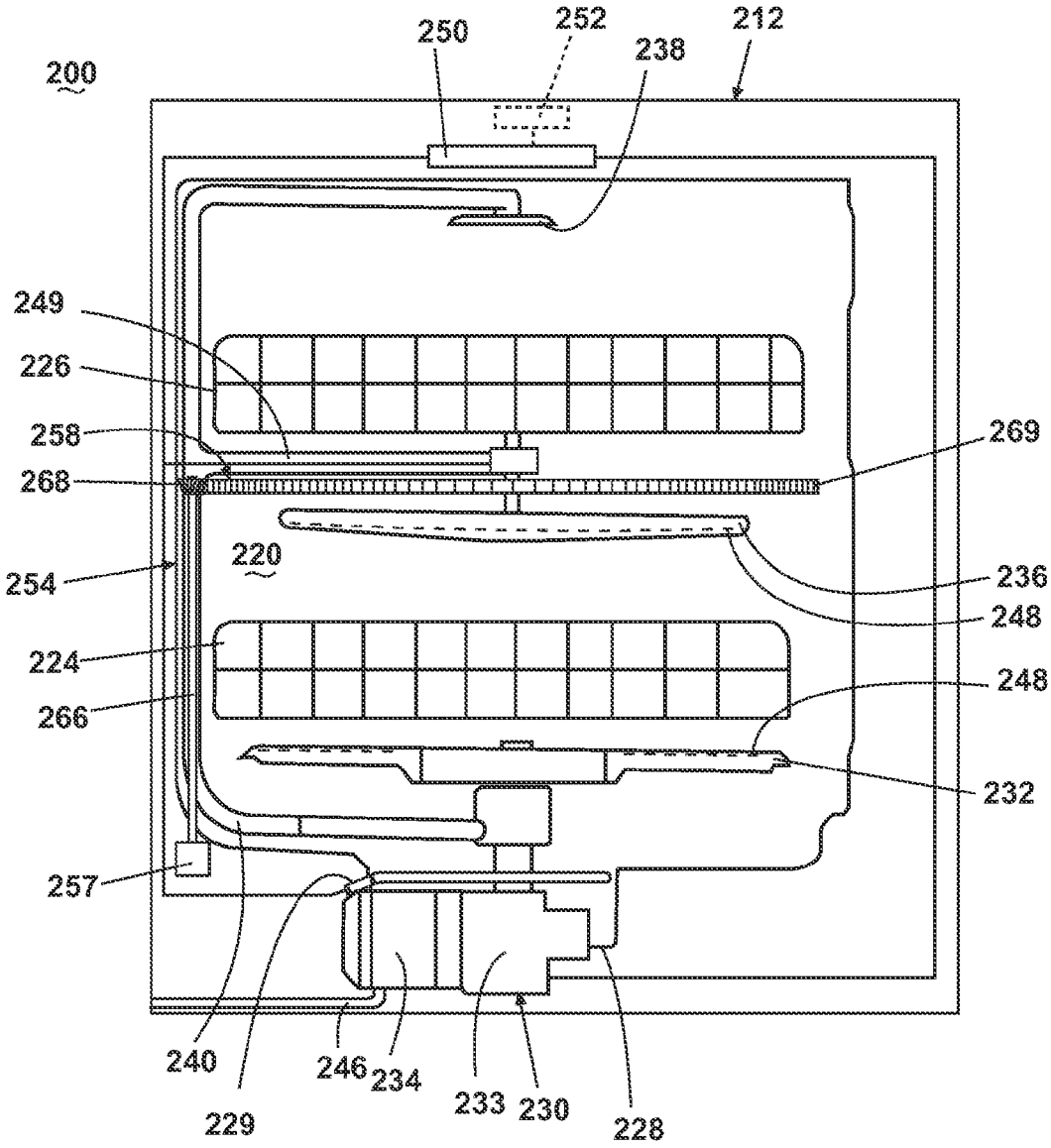
FIG. 4 is a side schematic view of the dishwasher according to another embodiment of the invention.

FIG. 4 is a side schematic view of a dishwasher 200 and drive system 254 according to a third embodiment of the invention. The third embodiment 200 is similar to the second embodiment 100. Therefore, like parts will be identified with like numerals increased by 100, with it being understood that the description of the like parts of the first embodiment applies to the second embodiment, unless otherwise noted.

One difference between the second embodiment 100 and the third embodiment 200 is that the drive unit 258 uses a stand alone gear 269 that meshes with an output gear 268, instead of the mid-level spray arm gear 160, drive shaft 162, and drive shaft output gear 164. This configuration provides for a more simple drive system 254. This configuration also provides for the independent control of the position of the spray arm assembly 236 and the spraying of liquid therefrom. Many useful spray strategies can be adopted when the position of the spray arm is controlled independently of the supply of liquid through the spray arm. For example, the spray arm may be stopped or slowed at locations where a greater spaying is desired, such as when the spray arm is directed to the corners of the rack.

Figure 5:
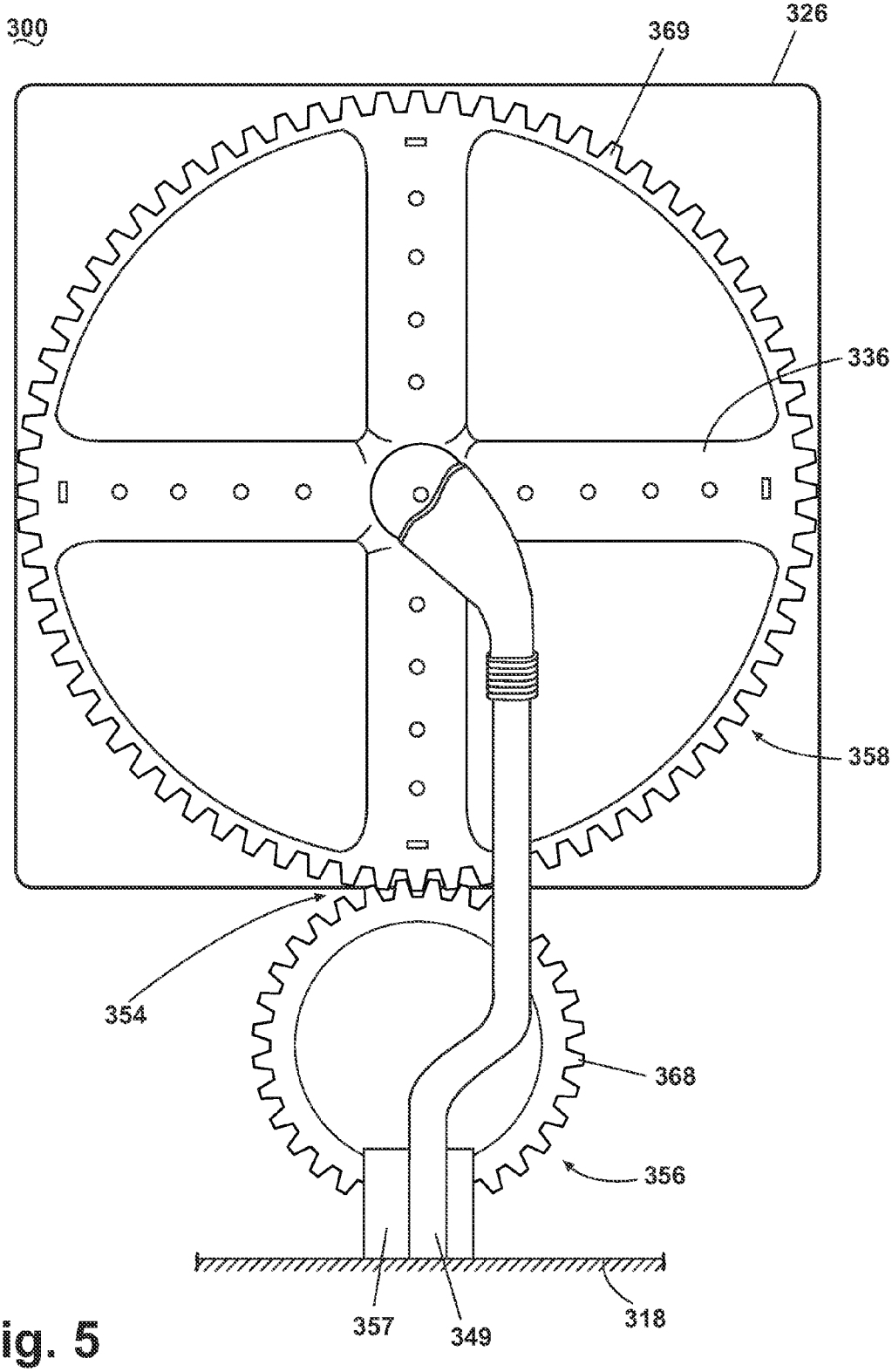
FIG. 5 is a top schematic view of a spray arm and drive system according to another embodiment of the invention.

FIG. 5 is a schematic view of a dishwasher 300 and drive system 354 according to a fourth embodiment of the invention. The fourth embodiment 300 is similar to the third embodiment 200. Therefore, like parts will be identified with like numerals increased by 100, with it being understood that the description of the like parts of the third embodiment applies to the fourth embodiment, unless otherwise noted.

One difference between the third embodiment 200 and the fourth embodiment 300 is that the power unit 356, specifically a motor 357 is located on the rear wall 318 spaced between the bottom wall 314 and top wall 310 (not shown). The power unit 356 also includes an output gear 368 adjacent the tub.

Further, the mid-level spray arm assembly 336 is located underneath the upper utensil rack 326 and is operably coupled to a drive unit 358 in the form of a drive gear 369. The mid-level spray arm assembly 336 is illustrated as being located inside and attached to the drive gear 369. Although the mid-level spray arm assembly 336 has been illustrated as having four arms, it may include any spray arm structure having at least three arms. A tip of each spray arm of the mid-level spray arm assembly 336 is coupled with the interior of the drive gear 369 such that when the drive gear 369 rotates the mid-level spray arm assembly 336 is also rotated.

The outer periphery of the drive gear 369 is enmeshed with the output gear 368. The output gear 368 provides a driving point for the drive gear 369. Multiple output gears may be used to make up the power unit 356 and provide rotational movement to the drive gear 369. In an alternative embodiment, multiple output gears (not shown) may be used with a drive gear that only has teeth along a portion of its outside. For example, half of the outside of the drive gear may have teeth (not shown) and multiple output gears may be used to ensure that the gear teeth are in constant contact with a drive point.

The drive gear 369 may be carried by the upper utensil rack 326 rotatable about an axis of rotation parallel to the mid-level spray arm assembly 336 axis of rotation. The drive gear 369 and the mid-level spray arm assembly 336 have been illustrated as having the same axis of rotation although this is not required. Along the outside of the drive gear 369 are gear teeth that engage the power unit 356. The drive gear 369 may have a periphery extending beyond the second rack. As illustrated, the drive gear 369 and mid-level spray arm assembly 336 form a wheel and spokes configuration, with the drive gear 369 forming the wheel and the mid-level spray arm assembly 336 forming the spokes. This configuration allows water to more easily drain from the drive system 354 to the sump 328.

Because the drive gear 369 and mid-level spray arm assembly 336 are carried by the upper utensil rack 326, they may be able to move in and out of the wash chamber 320. A flexible manifold tube 349 may allow for rotation of the mid-level spray arm assembly 336 and movement between the loading position and the wash position. The flexible manifold tube 349 is fluidly connected to the supply tube 340 to supply liquid to the mid-level spray arm assembly 336. Further, the drive gear 369 may selectively couple to the output gear 368. Thus, the drive unit 358 couples to the power unit 356 when the upper utensil rack 326 is in the wash position and the power unit 356 may provide an operating force to the drive unit 358 to effect the rotation of the mid-level spray arm assembly 336.

This configuration provides for a more simple drive system 354. This configuration also provides for the independent control of the position of the spray arm assembly 336 and the spraying of liquid therefrom. Many useful spray strategies can be adopted when the position of the spray arm is controlled independently of the supply of liquid through the spray arm. For example, the spray arm may be stopped or slowed at locations where a greater spaying is desired, such as when the spray arm is directed to the corners of the rack.

Figure 6:
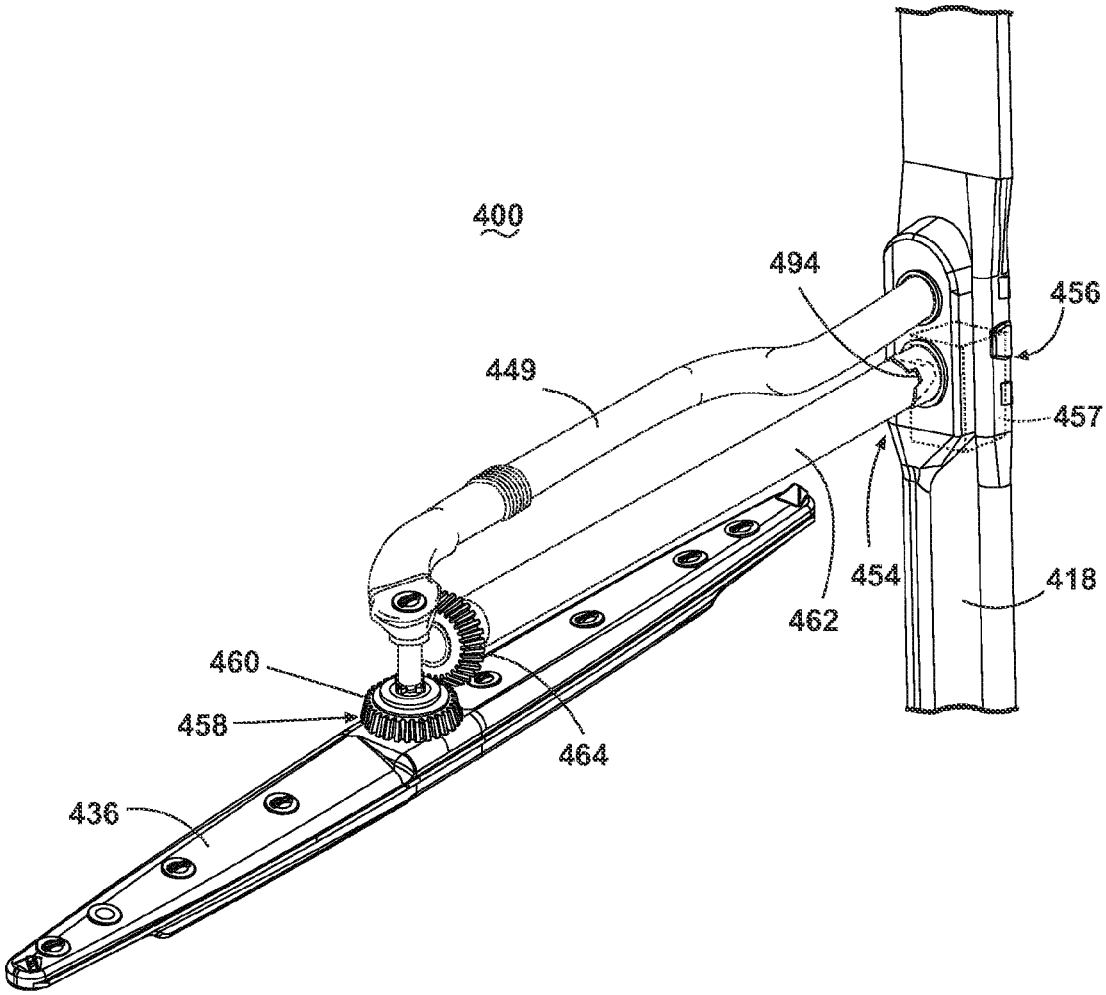
FIG. 6 is a perspective view of the spray arm and drive system according to another embodiment of the invention.

FIG. 6 is a perspective view of a drive system 454 in a dishwasher 400 according to a fifth embodiment of the invention. The fifth embodiment 400 is similar to the fourth embodiment 300. Therefore, like parts will be identified with like numerals increased by 100, with it being understood that the description of the like parts of the fourth embodiment applies to the fifth embodiment, unless otherwise noted.

The power unit 456, specifically a motor 457 is located on the rear wall 418 aligned with a mid-level spray assembly 436. The power unit also includes a drive shaft 462. The drive shaft 462 is operably coupled to the drive unit 458 such that the drive shaft 462 transfers relative rotational movement to the drive unit 458.

The drive unit 458 is illustrated as including a mid-level spray arm gear 460 operably coupled to the drive shaft 462, and a drive shaft output gear 464 associated with the mid-level spray arm assembly 436. The drive shaft output gear 464 is operably coupled to the mid-level spray arm gear 460 for transferring relative rotational movement therebetween. The mid-level spray arm gear 460 and drive shaft output gear 464 may be any suitable mechanism for translating the rotation of the drive shaft 462 to the mid-level spray arm assembly 436. Alternative mechanisms may include bevel gears, crossed helical gears or a worm gear assembly where the drive shaft output gear may actually be formed in the drive shaft.

The drive unit 458 is shown attached to the mid-level spray arm assembly 436 and aligned with the power unit 456. The drive unit 458 may be able to move in and out of the wash chamber 20 and the drive shaft 462 may selectively couple the motor 457. The drive shaft 462 may have an alignment device 494 to ensure that it correctly couples with the motor 457. The alignment device acts to ensure coupling of the drive unit 458 and the power unit 456 when the upper utensil rack (not shown) is moved to the wash position from the loading position.

The alignment device may be of any configuration so long as it ensures alignment between the drive unit 458 and the power unit 456 when the upper utensil rack is moved to the wash position. As illustrated, the alignment device 494 is a shaped portion of the drive shaft 462 and an output of the motor 457 such that the drive shaft 462 may be received within the motor 457 and may easily align with the output of the motor 457. Thus, the drive unit 458 is aligned with the power unit and couples to the power unit 456 when the upper utensil rack is in the wash position and the power unit 456 may provide an operating force to the drive unit 458 to effect the rotation of the mid-level spray arm assembly 436.

During operation of the dishwasher 400, the controller 450 may be employed to control the operation of the motor 457. The motor 457 may be able to operate in both a forward and reverse direction, if all of the components of the drive system 454 are capable of operating in both directions, then the mid-level spray arm assembly 436 may be driven in both a first rotational direction and in a direction opposite from the first rotational direction. This may help to clean utensils in the upper utensil rack 426. The controller 450 may control the time the motor 457 is operated in each direction. Further, the controller 450 may operate the motor 457 to slow or even stop the mid-level spray arm assembly 436. When the motor 457 is operated, the drive shaft 462 and the mid-level spray arm gear 460 are rotated. The mid-level spray arm gear 460 interconnects with the drive shaft output gear 464 and translates the rotational movement from the drive shaft 462 to drive rotation of the mid-level spray arm assembly 436.

Figure 7:
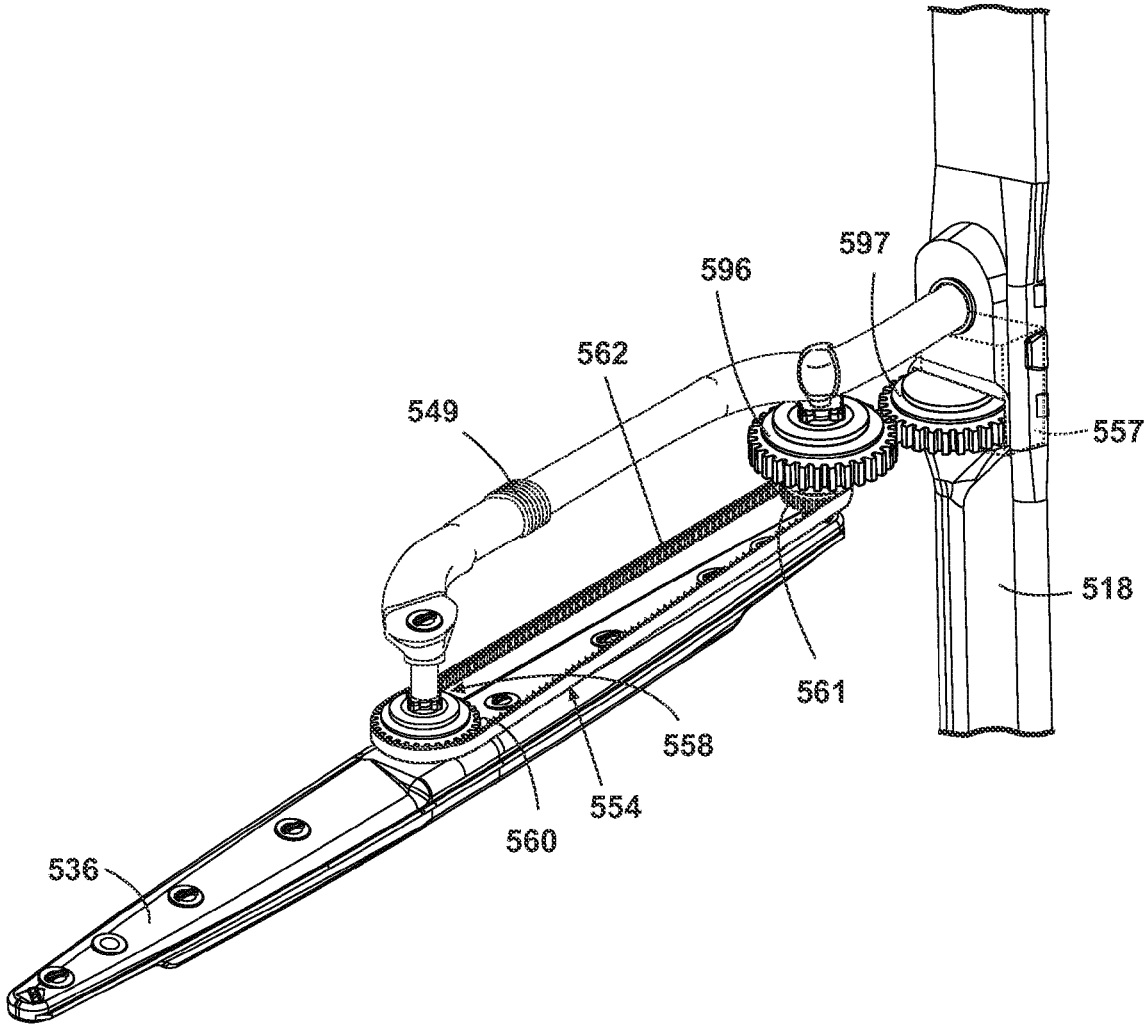
FIG. 7 is a perspective view of the spray arm and drive system according to another embodiment of the invention.

FIG. 7 is a perspective view of a drive system 554 in a dishwasher 500 according to a sixth embodiment of the invention. The sixth embodiment 500 is similar to the fifth embodiment 400. Therefore, like parts will be identified with like numerals increased by 100, with it being understood that the description of the like parts of the fifth embodiment applies to the sixth embodiment, unless otherwise noted.

One difference between the fifth embodiment 400 and the sixth embodiment 500 is that the drive system 554 includes a belt 562 instead of a drive shaft. In this embodiment, the power unit 556 includes the motor 557 and an output gear 597. The output gear 597 is operably coupled to the drive unit 558 such that operation of the motor 557 transfers relative rotational movement to the drive unit 558.

The drive unit 558 is illustrated as including a mid-level spray arm gear 560, a belt input gear 561, a belt 562, and a drive gear 596. The mid-level spray arm gear 560 is operably coupled to the mid-level spray arm assembly 536 and the belt 562. Alternatively, the belt 562 may be directly connected to the mid-level spray arm 536. The drive gear 596 is operably coupled to the belt input gear 561 such that relative rotational movement of the drive gear 596 is transferred to the belt input gear 561. Further, the drive gear 596 is enmeshed with the output gear 597.

During operation of the dishwasher 500, the controller 550 may be employed to control the operation of the motor 557. The motor 557 may be able to operate in both a forward and reverse direction, if all of the components of the drive system 554 are capable of operating in both directions, then the mid-level spray arm assembly 536 may be driven in both a first rotational direction and in a direction opposite from the first rotational direction. Further, the controller 550 may operate the motor 557 to slow or even stop the mid-level spray arm assembly 536.

When the motor 557 is operated, the output gear 597 provides a driving point for the drive gear 596. The drive gear 596 transfers relative rotational movement to the belt input gear. Rotation of the belt input gear drives the belt 562 and relative rotational movement is transferred to the mid-level spray arm gear 560 and the mid-level spray arm assembly 536.

Because the drive gear 596 and mid-level spray arm assembly 536 are carried by the upper utensil rack (not shown), they may be able to move in and out of the wash chamber. A flexible manifold tube 549 may allow for rotation of the mid-level spray arm assembly 536 and movement between the loading position and the wash position. The flexible manifold tube 549 is fluidly connected to the supply tube (not shown) to supply liquid to the mid-level spray arm assembly 536. Further, the drive gear 596 may selectively couple to the output gear 597. Thus, the drive unit 558 couples to the power unit 556 when the upper utensil rack is in the wash position and the power unit 556 may provide an operating force to the drive unit 558 to effect the rotation of the mid-level spray arm assembly 536.

While the specific embodiments of the invention have all been described in the context of the drive system causing a rotation motion of the spray arms, it should be noted that the invention is not so limited. For example, it is within the scope of the invention for the spray arm to move linearly instead of rotating. In such a structure the drive mechanism would effect the linear movement of the spray arm. It is also within the scope of the invention for the sprayer to be a configuration other than an arm. For example, it could be a nozzle that is rotated or moved linearly.

While the invention has been specifically described in connection with certain specific embodiments thereof, it is to be understood that this is by way of illustration and not of limitation, and the scope of the appended claims should be construed as broadly as the prior art will permit.

What is claimed is:

1. An automatic dishwasher, comprising:

a tub defining a wash chamber for receiving utensils to be washed;

a rack located within the wash chamber and selectively moveable between a loading position, where at least a portion of the rack extends exteriorly of the wash chamber, and a wash position where the rack is located entirely within the wash chamber;

a rotatable spray arm carried by the rack and located within the wash chamber when the rack is in the wash position and having a drive gear;

a liquid recirculation system for selectively supplying liquid to the rotatable spray arm;

a drive shaft extending horizontally in the wash chamber and having an output gear that is enmeshed with the drive gear when the rack is in the wash position;

a power unit that is operably coupled to the drive shaft when the rack is in the wash position to provide an operating force to rotate the drive shaft to effect the rotation of the spray arm; and a controller configured to control the power unit and the liquid recirculation system to rotate the rotatable spray arm while selectively supplying liquid to the rotatable spray arm;

wherein when the rack is in the loading position at least a portion of the rotatable spray arm is located exteriorly of the wash chamber and at least one of the drive shaft and the power unit are operably uncoupled from the rotatable spray arm.

2. The automatic dishwasher of claim 1 wherein the power unit comprises a motor.

3. The automatic dishwasher of claim 1 wherein the tub comprises a rear wall partially defining the wash chamber and the drive shaft projects from the rear wall.

4. The automatic dishwasher of claim 3 wherein the power unit resides on an opposite side of the rear wall than the wash chamber.

5. The automatic dishwasher of claim 1 wherein the rotatable spray arm includes a spray arm shaft and the drive gear is mounted to the spray arm shaft.

6. An automatic dishwasher, comprising:

a tub defining a wash chamber for receiving utensils to be washed;

a rack located within the wash chamber and selectively moveable between a loading position, where at least a portion of the rack extends exteriorly of the wash chamber, and a wash position where the rack is located entirely within the wash chamber;

a spray arm assembly comprising an elongated spray arm, a spray arm shaft extending transversely from the spray arm and defining an axis of rotation, and a drive gear coupled to the spray arm shaft and carried by the rack as the rack moves between the loading position and the wash position;

a liquid recirculation system for selectively supplying liquid to the spray arm;

a drive system comprising a horizontally oriented drive shaft extending into the wash chamber, an output gear on the drive shaft enmeshed with the drive gear, and a power unit operably coupled to the drive shaft to rotate the drive shaft to effect the rotation of the spray arm about the axis of rotation; and a controller configured to control the power unit and the liquid recirculation system to rotate the spray arm while selectively supplying liquid to the spray arm;

wherein when the rack is in the loading position at least a portion of the drive system is operably uncoupled from the rotatable spray arm.

7. The automatic dishwasher of claim 6 wherein the power unit comprises a motor operably coupled to the drive shaft.

8. The automatic dishwasher of claim 6 wherein the power unit comprises a cable operably coupled to the drive shaft.

9. The automatic dishwasher of claim 6 wherein the tub comprises a rear wall partially defining the wash chamber and the drive shaft projects from the rear wall.

10. The automatic dishwasher of claim 9 wherein the power unit resides on an opposite side of the rear wall than the wash chamber.

11. The automatic dishwasher of claim 6 wherein the power unit further comprises a shaft operably coupled to the drive shaft.

* * * * *